US011674202B2

(12) United States Patent
Guan et al.

(10) Patent No.: US 11,674,202 B2
(45) Date of Patent: Jun. 13, 2023

(54) HIGH-THROUGHOUT CONTINUOUS CASTING AND ROLLING AL—MG—MN ALLOY PLATE FOR SHIPS AND THE PREPARATION PROCESS THEREOF

(71) Applicant: ZHENGZHOU UNIVERSITY, Zhengzhou (CN)

(72) Inventors: Shaokang Guan, Zhengzhou (CN); Guangxi Lu, Zhengzhou (CN); Cong Xu, Zhengzhou (CN)

(73) Assignee: ZHENGZHOU UNIVERSITY, Zhengzhou (CN)

( * ) Notice: Subject to any disclaimer, the term of this patent is extended or adjusted under 35 U.S.C. 154(b) by 0 days.

(21) Appl. No.: 17/873,596

(22) Filed: Jul. 26, 2022

(65) Prior Publication Data

US 2023/0037513 A1 Feb. 9, 2023

(30) Foreign Application Priority Data

Jul. 26, 2021 (CN) ..... 202110846697.4

(51) Int. Cl.
*C22C 21/06* (2006.01)

(52) U.S. Cl.
CPC ..... *C22C 21/06* (2013.01)

(58) Field of Classification Search
None
See application file for complete search history.

(56) References Cited

FOREIGN PATENT DOCUMENTS

| | | | |
|---|---|---|---|
| CN | 106967907 | A | 7/2017 |
| CN | 108611533 | A | 10/2018 |
| CN | 111069549 | A | 4/2020 |

*Primary Examiner* — Brian D Walck
(74) *Attorney, Agent, or Firm* — WPAT, PC

(57) ABSTRACT

The invention discloses a high-throughout continuous casting and rolling Al—Mg—Mn alloy plate for ships and the preparation process thereof. The chemical components of the Al—Mg—Mn alloy in percentage by mass percentage are: Mg: 0.80-2.80%, Mn: 0.00-1.40%, Zr: 0.10-0.50%, Cr: 0.15-0.35%, Sr: 0.00-0.10%, Er: 0.00-0.60%, Si: 0.10-0.40%, Cu: 0.01-0.10%, Ti: 0.01-0.05%, Fe: 0.00-0.40% and the rest is Al. The preparation processes mainly include smelting and melt treatment, continuous casting, continuous rolling and cold rolling. The invention solves the problems of easy segregation, low strength and toughness and poor formability in the preparation of high-throughout continuous casting and rolling Al—Mg—Mn plates for ships.

1 Claim, No Drawings

HIGH-THROUGHOUT CONTINUOUS CASTING AND ROLLING AL—MG—MN ALLOY PLATE FOR SHIPS AND THE PREPARATION PROCESS THEREOF

BACKGROUND OF THE INVENTION

1. Field of the Invention

The invention belongs to the technical field of aluminum alloy plate processing, and particularly relates to a high-throughout continuous casting and rolling Al—Mg—Mn alloy plate for ships and the preparation process thereof.

2. Description of Related Art

Al—Mg—Mn alloys have the characteristics of low density, light weight, high strength, good electrical and thermal conductivity and excellent corrosion resistance. It is widely used in the manufacture of aircraft fuel tanks, oil pipes, sheet metal parts of transportation vehicles and ships, instruments, street lamp brackets, rivets and hardware products. With the continuous and rapid development of China's marine industry, the requirements for Al—Mg—Mn alloy plates are getting higher and the demand is increasing in the ship industry for lightweighting. At present, the main process for preparing Al—Mg—Mn alloy is hot rolling with a long and complicated preparation process, and high energy consumption and preparation cost. However, the high-throughout continuous casting and rolling process has the advantages of short and fast preparation process, large flux, and low energy consumption and cost. However, most Al—Mg—Mn—Al alloys have a large crystallization temperature range during the crystallization process, this leads to deteriorated fluidity of the alloy in the high-throughout continuous casting and rolling process, resulting in defects such as structure segregation, porosity and shrinkage cavity. Therefore, it is urgent to develop a preparation process of high-throughout continuous casting and rolling for customized Al—Mg—Mn alloy plates, in order to meet the requirements of lightweighting ships for aluminum alloy plates in aspect of strength, toughness and formability.

SUMMARY OF THE INVENTION

The invention provides a high-throughout continuous casting-rolling Al—Mg—Mn alloy plate for ships and the preparation process thereof. Based on computer simulation and experimental research, the preparation reduces the crystallization temperature range of Al—Mg—Mn alloys by systematically adjusting the contents of Mg and Mn elements; it realizes the strength and toughness of the alloy that meets the industrial demands by micro-alloyed structure control; and it realizes the processing and forming of the finished products of ship plates by setting the high-throughout continuous casting-rolling process parameters.

The purpose of the invention can be realized as follows:

A high-throughout continuous casting and rolling Al—Mg—Mn alloy plate for ships, containing the following chemical components in percentage by mass: Mg: 0.80-2.80%, Mn: 0.00-1.40%, Zr: 0.10-0.50%, Cr: 0.15-0.35%, Sr: 0.00-0.10%, Er: 0.00-0.60%, Si: 0.10-0.40%, Cu: 0.01-0.10%, Ti: 0.01-0.05%, Fe: 0.00-0.40%, and the rest is Al.

A high-throughout continuous casting and rolling Al—Mg—Mn alloy plate for ships like above, containing the following chemical components in percentage by mass: Mg: 0.80-1.50%, Mn: 0.00-0.40%, Zr: 0.10-0.20%, Cr: 0.2-0.35%, Sr: 0.00-0.05%, Er: 0.30-0.60%, Si: 0.10-0.30%, Cu: 0.01-0.60%, Ti: 0.03-0.05%, Fe: 0.00-0.10%, and the rest is Al.

A high-throughout continuous casting and rolling Al—Mg—Mn alloy plate for ships like above, containing the following chemical components in percentage by mass: Mg: 1.50-2.80%, Mn: 0.4-1.40%, Zr: 0.20-0.50%, Cr: 0.15-0.2%, Sr: 0.05-0.10%, Er: 0.00-0.30%, Si: 0.30-0.40%, Cu: 0.06-0.10%, Ti: 0.01-0.03%, Fe: 0.10-0.40%, and the rest is Al.

A high-throughout continuous casting and rolling Al—Mg—Mn alloy plate for ships like above, containing the following chemical components in percentage by mass: Mg: 1.50%, Mn: 0.80%, Zr: 0.20%, Cr: 0.25%, Sr: 0.06%, Er: 0.20%, Si: 0.10%, Cu: 0.05%, Ti: 0.02%, Fe: 0.10%, and the rest is Al.

A high-throughout continuous casting and rolling Al—Mg—Mn alloy plate for ships like above, containing the following chemical components in percentage by mass: Mg: 1.50%, Mn: 0.80%, Zr: 0.20%, Cr: 0.25%, Sr: 0.06%, Er: 0.20%, Si: 0.10%, Cu: 0.05%, Ti: 0.02%, Fe: 0.10%, and the rest is Al.

A high-throughout continuous casting and rolling Al—Mg—Mn alloy plate for ships like above, containing the following chemical components in percentage by mass: Mg: 1.50%, Mn: 0.80%, Zr: 0.20%, Cr: 0.25%, Sr: 0.06%, Er: 0.40%, Si: 0.10%, Cu: 0.05%, Ti: 0.02%, Fe: 0.10%, and the rest is Al.

The preparation processes of the high-throughout continuous casting and rolling Al—Mg—Mn alloy plates for ships like above mainly include smelting and melt treatment, continuous casting, continuous rolling and cold rolling:

Step 1: Smelting and Melt Treatment (1) After cleaning the smelting furnace, add electrolytic aluminum liquid into it, specifically, put 65-70% of electrolytic aluminum liquid and 30-35% of aluminum ingot with the content of aluminum element more than or equal to 99.8% into the furnace for smelting to obtain aluminum melt;

(2) Alloying: add Al—Mn master alloy ingot, Al—Cu master alloy ingot, Al—Si master alloy ingot and pure magnesium ingot into the aluminum melt in sequence at the above ratio, and preheat the master alloy ingots to 250□ in a preheating furnace before being added; the Al—Mn master alloy ingot is AlMn20 with 20% mass fraction of Mn in the alloy; Al—Cu master alloy ingot is AlCu50 with 50% mass fraction of Cu in the alloy; the Al—Si master alloy ingot is AlSi10 with 10% mass fraction of Si in the alloy; the purity of pure magnesium ingot is 99.5%;

(3) Electromagnetic stirring: after the completion of furnace charge melting, carry out clockwise-counterclockwise alternate electromagnetic stirring, then stop stirring, and after the molten alloy is stable, carry out slag removal in time within the temperature range of 750-780° C.;

(4) Electromagnetic stirring: refining: after slag removal, when the temperature reaches 750-780° C., refine the aluminum liquid with the mixed gas of argon and chlorine for the first time for 35-40 min;

(5) Microalloying: add the Al—Zr master alloy ingot, the Al—Sc master alloy ingot and the Al—Er master alloy ingot into the aluminum melt in sequence, with the temperature of the melt controlled at 750-780° C. during adding, and the master alloy ingots preheated to 250-300° C. in a preheating furnace before being added and then added into the aluminum melt in the furnace by a mechanical feeding device; the Al—Zr master alloy ingot is AlZr5 master alloy ingot with 5% mass fraction of Zr in the alloy, the Al—Sc master alloy ingot is AlSc2 master alloy ingot with 2% mass fraction of Sc in the alloy, and the Al—Er master alloy ingot is AlEr5 master alloy ingot with 5% mass fraction of Er in the alloy.

(6) Refining, electromagnetic stirring, and component testing: the refining is the same as step 4; the electromagnetic stirring time shall be ≤30 min; the components shall be tested: samples shall be taken from three different parts of the furnace at 750-780° C. and sent to the physical and chemical lab for testing; if the uniformity of the tested components after stirring fail to meet the requirements, continue stirring for 5-8 min;

(7) Component supplementing, standing, and furnace tilting: supplement the alloy and microalloying element components which are insufficient in the melt treatment process, with adding methods the same as steps 2 and 5, and then stand the furnace after refining again, and start the furnace for high-throughout continuous casting and rolling process after the standing time is more than or equal to 70 min;

Step 2: Continuous Casting (1) Grain refinement: conduct grain refinement by a rod-shaped AlTi5B1 wire rod with a diameter of 10 mm, with the consumption of 2.0 Kg/T and the wire feeding rate of 5 m/min, and add the screw rod into the launder in front of SNIF by a wire feeding mechanism; it shall be ensured that there is the above-proportion titanium element in the aluminum melt;

(2) On-line degassing, slag removal and hydrogen measurement: carry out on-line treatment by SNIF degassing device, with the gas of Ar and 1.0% chlorine by volume for refining; conduct single-stage filtration with the filter box: an imported 50-mesh ceramic plate is used as filter plate, and the filter box is switched every 100T but cannot be done within 20 min after switching the furnace; it is required that the hydrogen content of molten aluminum in the filter box is less than 0.10 ml/100 g;

(3) Ultrasonic: purify and degas the melt by applying ultrasonic waves to the launder and the filter box, and the ultrasonic vibration system comprises an ultrasonic power supply, an ultrasonic transducer, an amplitude transformer and a radiating rod, wherein the output power of the ultrasonic power supply is 2-4 kW, the vibration frequency is 15-30 kHz, and the length and diameter of the radiating rod are 490 mm and 50 mm respectively; the application mode is that the radiating rod is vertically introduced into the melt from top to bottom to apply continuous ultrasound to the melt;

(4) Continuous casting: inject the aluminum melt into two oppositely rotating "HC3, HC4" steel belts through the "SL" nozzle. During continuous casting, the temperature of the molten aluminum in the filter box of the casting machine is kept at 700-720□, the continuous casting rate is controlled at 8-10 m/min, the cooling rate is 60-70□/s, and the width and thickness of the continuous casting ingot are 1950 mm and 19±1 mm respectively.

(5) On-line temperature measurement: the spray temperature control system is used to ensure that the temperature of the ingot is controlled in the range of 550-610□ through the on-line infrared thermometer;

Step 3: Continuous Rolling (1) Plate and strip adjustment: the bending of alloy plate and strip is controlled and the position of plate and strip is adjusted by tilting the arc roller table;

(2) Continuous rolling temperature control: the customized alloy continuous casting ingot with the temperature controlled in the range of 550-610° C. is directly sent into the triple rolling system;

(3) Continuous rolling: roll the blank to a suitable thickness when it has waste heat;

Step 4: Cold Rolling (1) Rolling: roll the above blank to a certain thickness in three times, with a reduction rate of more than 30% each time, and refine the grain with a large deformation;

(2) Intermediate annealing: conduct intermediate annealing after rolling;

(3) Finished product inspection: check the packaging process to obtain alloy products.

The finished products are inspected as follows:

Crystallization range detection: use the full-auto differential thermal balance instrument of Beijing Permanent Laboratory Equipment Co., Ltd, model: HQT, No.: 050, with the specific analysis method: put 10 mg of alloy into the crucible, measure the DSC curve with vertical rate of 10□/min under the protection of Ar gas, and use the analysis software of the instrument to obtain the specific crystallization range. Tensile strength and elongation test: use universal testing machine of Shimadzu Instrument Co., Ltd., Japan, model: SFL-50KNAG, No.: N109001, with the specific method: cut the tensile sample by wire cutting technology, and then stretch at a stretching rate of 0.2 mm/min to obtain the tensile curve and then the tensile strength. Elongation: make the gauge L0 before stretching and measure the gauge L1 after stretching to calculate the elongation: $\delta=(\delta=(L1-L0)/L0\times100\%$.

The high-throughout continuous casting and rolling Al—Mg—Mn alloy plate for ships like above can be applied to air-conditioning sheet metal parts for ships.

Compare with the prior technologies, the invention has the advantages that:

1. Based on computer simulation and experimental research, the preparation reduces the crystallization temperature range by systematically adjusting the contents of Mg and Mn elements in Al—Mg—Mn (5xxx) alloy; realizes the strength and toughness of the alloy meeting the industrial demand by micro-alloying structure control; realizes the processing and forming of the finished ship plates by setting the high-throughout continuous casting and rolling process parameters.

2. The invention solves the problems of easy segregation, low strength and toughness and poor formability in the preparation of high-throughout continuous casting and rolling Al—Mg—Mn plate for ships, and meets the application requirements of lightweight ships on the strength, toughness and formability of aluminum alloy plates, and has the advantages of short and fast process, large flux, low energy consumption, light weight, etc.

DETAILED DESCRIPTION OF THE PREFERRED EMBODIMENTS

The invention will be further explained with reference to the following embodiments:

Embodiment 1

The preparation processes of the above high-throughout continuous casting and rolling Al—Mg—Mn alloy plate for air-conditioning sheet metal parts for ships mainly include smelting and melt treatment, continuous casting, continuous rolling and cold rolling:

Step 1: Smelting and Melt Treatment (1) After cleaning the smelting furnace, add electrolytic aluminum liquid into it, specifically, put 78t of electrolytic aluminum liquid and 22t of aluminum ingot with the content of aluminum element more than or equal to 99.8% into the furnace for smelting to obtain aluminum melt;

(2) Alloying: add Al—Mn master alloy ingot, Al—Cu master alloy ingot, Al—Si master alloy ingot and pure magnesium ingot into the aluminum melt in sequence at the above ratio, and preheat the master alloy ingots to 250□ in a preheating furnace before being added; the Al—Mn master alloy ingot is AlMn20 with 20% mass fraction of Mn in the alloy; Al—Cu master alloy ingot is AlCu50 with 50% mass fraction of Cu in the alloy; the Al—Si master alloy ingot is AlSi10 with 10% mass fraction of Si in the alloy; the purity of pure magnesium ingot is 99.5%;

(3) Electromagnetic stirring: after the completion of furnace charge melting, carry out clockwise-counterclockwise alternate electromagnetic stirring, then stop stirring, and after the molten alloy is stable, carry out slag removal in time within the temperature range of 760° C.;

(4) Electromagnetic stirring: refining: after slag removal, when the temperature reaches 760° C., refine the aluminum liquid with the mixed gas of argon and chlorine for the first time for 40 min;

(5) Microalloying: add the Al—Zr master alloy ingot, the Al—Sc master alloy ingot and the Al—Er master alloy ingot into the aluminum melt in sequence, with the temperature of the melt controlled at 760° C. during adding, and the master alloy ingots preheated to 250° C. in a preheating furnace before being added and then added into the aluminum melt in the furnace by a mechanical feeding device; the Al—Zr master alloy ingot is AlZr5 master alloy ingot with 5% mass fraction of Zr in the alloy, the Al—Sc master alloy ingot is AlSc2 master alloy ingot with 2% mass fraction of Sc in the alloy, and the Al—Er master alloy ingot is AlEr5 master alloy ingot with 5% mass fraction of Er in the alloy;

(6) Refining, electromagnetic stirring, and component testing: the refining is the same as step 4; the electromagnetic stirring time shall be 25 min; the components shall be tested: samples shall be taken from three different parts of the furnace at 760° C. and sent to the physical and chemical lab for testing; if the uniformity of the tested components after stirring fail to meet the requirements, continue stirring for 8 min;

(7) Component supplementing, standing, and furnace tilting: supplement the alloy and microalloying element components which are insufficient in the melt treatment process, with adding methods the same as steps 2 and 5, and then stand in the furnace after refining again, and start the furnace for high-throughout continuous casting and rolling process after the standing time is more than or equal to 80 min;

Step 2: Continuous Casting (1) Grain refinement: conduct grain refinement by a rod-shaped AlTi5B1 wire rod with a diameter of 10 mm, with the consumption of 2.0 Kg/T and the wire feeding rate of 5 m/min, and add the screw rod into the launder in front of SNIF by the wire feeding mechanism; it shall be ensured that there is the titanium element in the above proportion in the aluminum melt;

(2) On-line degassing, slag removal and hydrogen measurement: carry out on-line treatment by SNIF degassing device, with the gas of Ar and 1.0% chlorine by volume for refining; conduct single-stage filtration with the filter box: an imported 50-mesh ceramic plate is used as filter plate, and the filter box is switched every 100T but cannot be done within 20 min after switching the furnace; it is required that the hydrogen content of molten aluminum in the filter box is less than 0.10 ml/100 g;

(3) Ultrasonic: purify and degas the melt by applying ultrasonic waves to the launder and the filter box, and the ultrasonic vibration system comprises an ultrasonic power supply, an ultrasonic transducer, an amplitude transformer and a radiating rod, wherein the output power of the ultrasonic power supply is 4 kW, the vibration frequency is 20 kHz, and the length and diameter of the radiating rod are 490 mm and 50 mm respectively; the application mode is that the radiating rod is vertically introduced into the melt from top to bottom and apply continuous ultrasound to the melt;

(4) Continuous casting: inject the aluminum melt into two oppositely rotating "HC3, HC4" steel belts through the "SL" nozzle. During continuous casting, the temperature of the molten aluminum in the filter box of the casting machine is kept at 710□, the continuous casting rate is controlled at 10 m/min, the cooling rate is 60□/s, the width and thickness of the continuous casting ingot is 1950 mm and 19±1 mm respectively;

(5) On-line temperature measurement: the spray temperature control system is used to ensure that the temperature of the ingot is controlled in the range of 600□ through the on-line infrared thermometer;

Step 3: Continuous Rolling (1) Plate and strip adjustment: the bending of alloy plate and strip is controlled and the position of plate and strip is adjusted by tilting the arc roller table;

(2) Continuous rolling temperature control: the customized alloy continuous casting ingot with the temperature controlled in the range of 600° C. is directly sent into the triple rolling system;

(3) Continuous rolling: roll the blank to a suitable thickness when it has waste heat;

Step 4: Cold Rolling (1) Rolling: roll the above blank to a certain thickness in three times, with a reduction rate of more than 30% each time, and refine the grain with a large deformation;

(2) Intermediate annealing: conduct intermediate annealing after rolling;

(3) Finished product inspection: check the packaging process to obtain alloy products.

Embodiment 2

The invention provides a high-throughout continuous casting and rolling Al—Mg—Mn alloy plate for air-conditioning sheet metal parts for ships. The chemical components of the Al—Mg—Mn alloy by mass percentage are: Mg: 1.70%, Mn: 0.70%, Zr: 0.20%, Sr: 0.00%, Er: 0.00%, Cr: 0.25%, Si: 0.10%, Cu: 0.05%, Ti: 0.02%, Fe: 0.10%, and the rest is Al; the proportioning product is named M2.

The preparation method of the embodiment is the same as that of Embodiment 1.

Embodiment 3

The invention provides a high-throughout continuous casting and rolling Al—Mg—Mn alloy plate for air-conditioning sheet metal parts for ships. The chemical components of the Al—Mg—Mn alloy by mass percentage are: Mg: 1.90%, Mn: 0.60%, Zr: 0.20%, Sr: 0.00%, Er: 0.00%, Cr: 0.25%, Si: 0.10%, Cu: 0.05%, Ti: 0.02%, Fe: 0.10%, and the rest is Al; the proportioning product is named M3.

The preparation method of the embodiment is the same as that of Embodiment 1.

Embodiment 4

The invention provides a high-throughout continuous casting and rolling Al—Mg—Mn alloy plate for air-conditioning sheet metal parts for ships. The chemical components of Al—Mg—Mn alloy by mass percentage are: Mg: 2.50%, Mn: 0.00%, Zr: 0.20%, Cr: 0.25%, Sr: 0.00%, Er: 0.00%, Si: 0.10%, Cu: 0.05%, Ti: 0.02%, Fe: 0.10%, and the rest is Al; the proportioning product is named M4.

The preparation method of the embodiment is the same as that of Embodiment 1.

Embodiment 5

The invention provides a high-throughout continuous casting and rolling Al—Mg—Mn alloy plate for air-conditioning sheet metal parts for ships. The chemical components of the Al—Mg—Mn alloy by mass percentage are: Mg: 1.50%, Mn: 0.80%, Zr: 0.20%, Cr: 0.25%, Sr: 0.03%, Er: 0.00%, Si: 0.10%, Cu: 0.05%, Ti: 0.02%, Fe: 0.10%, and the rest is Al; the proportioning product is named M5.

The preparation method of the embodiment is the same as that of Embodiment 1.

Embodiment 6

The invention provides a high-throughout continuous casting and rolling Al—Mg—Mn alloy plate for air-conditioning sheet metal parts for ships. The chemical components of the Al—Mg—Mn alloy by mass percentage are: Mg: 1.50%, Mn: 0.80%, Zr: 0.20%, Cr: 0.25%, Sr: 0.06%, Er: 0.00%, Si: 0.10%, Cu: 0.05%, Ti: 0.02%, Fe: 0.10%, and the rest is Al; the proportioning product is named M6.

The preparation method of the embodiment is the same as that of Embodiment 1.

Embodiment 7

The invention provides a high-throughout continuous casting and rolling Al—Mg—Mn alloy plate for air-conditioning sheet metal parts for ships. The chemical components of the Al—Mg—Mn alloy by mass percentage are: Mg: 1.50%, Mn: 0.80%, Zr: 0.20%, Cr: 0.25%, Sr: 0.09%, Er: 0.00%, Si: 0.10%, Cu: 0.05%, Ti: 0.02%, Fe: 0.10%, and the rest is Al; the proportioning product is named M7.

The preparation method of the embodiment is the same as that of Embodiment 1.

Embodiment 8

The invention provides a high-throughout continuous casting and rolling Al—Mg—Mn alloy plate for air-conditioning sheet metal parts for ships. The chemical components of Al—Mg—Mn alloy by mass percentage are: Mg: 1.50%, Mn: 0.80%, Zr: 0.20%, Cr: 0.25%, Sr: 0.06%, Er: 0.20%, Si: 0.10%, Cu: 0.05%, Ti: 0.02%, Fe: 0.10%, and the rest is Al; the proportioning product is named M8.

The preparation method of the embodiment is the same as that of Embodiment 1.

Embodiment 9

The invention provides a high-throughout continuous casting and rolling Al—Mg—Mn alloy plate for air-conditioning sheet metal parts for ships. The chemical components of Al—Mg—Mn alloy by mass percentage are: Mg: 1.50%, Mn: 0.80%, Zr: 0.20%, Cr: 0.25%, Sr: 0.06%, Er: 0.40%, Si: 0.10%, Cu: 0.05%, Ti: 0.02%, Fe: 0.10%, and the rest is Al; the proportioning product is named M9.

The preparation method of the embodiment is the same as that of Embodiment 1.

See Table 2 for the testing results of tensile strength, elongation and crystallization temperature range of M1-M9 products. Crystallization range testing: use the full-auto differential thermal balance instrument of Beijing Permanent Laboratory Equipment Co., Ltd, model: HQT, No.: 050, with the specific analysis method: put 10 mg of alloy into the crucible, measure the DSC curve with vertical rate of 10□/min under the protection of Ar gas, and use the analysis software of the instrument to obtain the specific crystallization range. Tensile strength and elongation test: use universal testing machine of Shimadzu Instrument Co., Ltd., Japan, model: SFL-50KNAG, No.: N109001, with the specific method: cut the tensile sample by wire cutting technology, and then stretch at a stretching rate of 0.2 mm/min to obtain the tensile curve, and then the tensile strength. Elongation: make the gauge L0 before stretching and measure the gauge L1 after stretching to calculate the elongation: $\delta=(\delta=(L1-L0)/L0\times100\%$.

Table 1 shows the mass fraction of each component of the aluminum alloy provided in Embodiments 1-7.

| No. | Mg/% | Mn/% | Zr/% | Sr/% | Er/% | Cr/% | Si/% | Cu/% | Ti/% | Fe/% | Al/% |
|---|---|---|---|---|---|---|---|---|---|---|---|
| Embodiment 1 | 1.50 | 0.80 | 0.20 | 0.00 | 0.00 | 0.25 | 0.10 | 0.05 | 0.20 | 0.10 | Rest |
| Embodiment 2 | 1.70 | 0.70 | 0.20 | 0.00 | 0.00 | 0.25 | 0.10 | 0.05 | 0.20 | 0.10 | Rest |
| Embodiment 3 | 1.90 | 0.60 | 0.20 | 0.00 | 0.00 | 0.25 | 0.10 | 0.05 | 0.20 | 0.10 | Rest |
| Embodiment 4 | 2.50 | 0.00 | 0.20 | 0.00 | 0.00 | 0.25 | 0.10 | 0.05 | 0.20 | 0.10 | Rest |
| Embodiment 5 | 1.50 | 0.80 | 0.20 | 0.03 | 0.00 | 0.25 | 0.10 | 0.05 | 0.20 | 0.10 | Rest |
| Embodiment 6 | 1.50 | 0.80 | 0.20 | 0.06 | 0.00 | 0.25 | 0.10 | 0.05 | 0.20 | 0.10 | Rest |
| Embodiment 7 | 1.50 | 0.80 | 0.20 | 0.09 | 0.00 | 0.25 | 0.10 | 0.05 | 0.20 | 0.10 | Rest |
| Embodiment 8 | 1.50 | 0.80 | 0.20 | 0.60 | 0.20 | 0.25 | 0.10 | 0.05 | 0.20 | 0.10 | Rest |
| Embodiment 9 | 1.50 | 0.80 | 0.20 | 0.60 | 0.40 | 0.25 | 0.10 | 0.05 | 0.20 | 0.10 | Rest |

Table 2 shows the mechanical properties and crystallization range of each component of the aluminum alloy provided in Embodiment 1-7.

| Product | Tensile strength/MPa | Elongation/% | Crystallization range/° C. |
|---|---|---|---|
| M1 | 201.6 | 17.5 | 10.2 |
| M2 | 190.0 | 18.6 | 12.4 |
| M3 | 205.4 | 17.2 | 15.3 |
| M4 | 202.1 | 17.3 | 22.9 |
| M5 | 213.1 | 18.0 | 10.5 |
| M6 | 220.5 | 18.2 | 10.3 |
| M7 | 214.7 | 17.9 | 10.6 |
| M8 | 225.6 | 18.1 | 10.8 |
| M9 | 230.8 | 18.4 | 10.5 |

The above description is only put forward as an implementable technical scheme of the invention, not as a single restriction on the technical scheme itself. Although the invention has been illustrated and described with specific embodiments, it shall be realized that the above embodiments are only used to illustrate the technical scheme of the invention, but not to limit it; those skilled in the field shall understand that the technical scheme described in the foregoing embodiments can be modified or some or all technical features can be equivalently substituted without departing from the spirit and scope of the present invention; these modifications or substitutions do not make the essence of the corresponding technical scheme depart from the scope of the technical scheme of various embodiments of the invention; therefore, it is meant to include all such substitutions and modifications that fall within the scope of the invention in the appended claims.

The invention claimed is:

1. A continuous casting and rolling Al—Mg—Mn alloy plate for ships, wherein a chemical composition of the Al—Mg—Mn alloy consists of, by mass: Mg: 1.50%, Mn: 0.80%, Zr: 0.20%, Cr: 0.25%, Sr: 0.06%, Er: 0.20%, Si: 0.10%, Cu: 0.05%, Ti: 0.02%, Fe: 0.10%, and the rest is Al.

* * * * *